US005179832A

United States Patent [19]

Barcza et al.

[11] Patent Number: 5,179,832

[45] Date of Patent: Jan. 19, 1993

[54] AUGMENTER FLAME HOLDER CONSTRUCTION

[75] Inventors: William K. Barcza, Stuart; Steven M. Kessell, West Palm Beach, both of Fla.

[73] Assignee: United Technologies Corporation, Hartford, Conn.

[21] Appl. No.: 736,558

[22] Filed: Jul. 26, 1991

[51] Int. Cl.[5] ..... F02K 3/10

[52] U.S. Cl. ..... 60/261; 60/749

[58] Field of Search ..... 60/261, 264, 737, 738, 60/743, 747, 749

[56] References Cited

U.S. PATENT DOCUMENTS

| | | | |
|---|---|---|---|
| 3,269,115 | 8/1966 | Nelson, Jr. | 60/261 |
| 3,355,884 | 12/1967 | Poucher et al. | 60/743 |
| 3,719,042 | 3/1973 | Chamberlain | 60/261 |
| 3,800,527 | 4/1974 | Marshall et al. | 60/749 |
| 4,259,839 | 4/1981 | Bayle Laboure et al. | 60/261 |
| 4,315,401 | 2/1982 | Beal et al. | 60/261 |
| 4,398,388 | 8/1983 | Langston, Jr. | 60/241 |
| 4,490,973 | 1/1985 | Kinsey | 60/261 |
| 4,765,136 | 8/1988 | Clements et al. | 60/261 |
| 4,802,337 | 2/1989 | Caruel | 60/261 |
| 4,815,283 | 3/1989 | Eldredge et al. | 60/261 |

*Primary Examiner*—Richard A. Bertsch
*Assistant Examiner*—Howard R. Richman
*Attorney, Agent, or Firm*—Edward L. Kochey, Jr.

[57] ABSTRACT

Shrouds 22, 24 are welded to support braces 20 near fuel spray ring 12. A splash shield 30 is secured to shroud 22 toward which fuel 16 is sprayed. It extends between braces protecting the shroud 22 from fuel impingement. Cracking of the structure at the shroud-brace interface is avoided.

10 Claims, 5 Drawing Sheets

AUGMENTER FLAME HOLDER CONSTRUCTION

The Government has rights in this invention pursuant to a contract awarded by the Department of the Air Force.

TECHNICAL FIELD

The invention relates to augmented gas turbine engines and in particular to the flameholder therein.

BACKGROUND OF THE INVENTION

Gas turbine engines in an aircraft may obtain additional thrust by the use of augmentors or afterburners. Fuel is injected into the gas stream at a location downstream of the turbine. The fuel is ignited and burned prior to gas exhaust through the nozzle.

In this high velocity airstream it is difficult to maintain a stable flame front. For this purpose flameholders are used. They conventionally are in the form of V or U-shaped gutters with the opening facing downstream. This produces a local turbulence retaining the flame front at the gutter. These gutters will often comprise an annular gutter plus some radial gutters extending outwardly therefrom.

The fuel injection may be staged through different injection points. One of these stages, usually the first one, is located just upstream of an annular gutter. A spray ring is used to introduce the fuel at this location. Shrouds are used to confine the air and fuel in the gutters' area.

The spray ring will generally introduce the fuel transverse to the gas flow at the location just upstream of the gutter. This provides a dynamic interaction between the high velocity airflow and the fuel promoting atomization and mixing.

Cracking has occurred where the shroud supports are connected to the shrouds. This apparently has resulted from low cycle fatigue damage caused by temperature differences during certain operations.

SUMMARY OF THE INVENTION

A gas turbine engine has an augmentor including a fuel spray ring located in the axial airflow downstream of the turbine. A flameholder therefor includes a circumferential gutter located immediately downstream of the spray ring. There is a circumferential inner shroud located radially inside of the gutter. A circumferential outer shroud is located radially outside the gutter with the fuel and airflow confined between these shrouds.

A plurality of support braces are welded to one or both the shrouds, at circumferentially spaced locations. A splash shield is secured to this shroud and interposed between the shroud and the spray ring in the area between the support braces. Any unvaporized fuel which would otherwise strike and quench the shroud is thereby intercepted by this splash shield.

The splash shield is secured to the shroud at a location remote from the spray ring. Bending the shroud at the upstream support location in a direction away from the spray ring permits welding of the shield to the shroud at that point so that strains caused by local quenching of the shield cannot readily be transferred to the shroud. The splash shield is also slidably supported at the downstream end from the shroud whereby the strains caused by any local quenching are relieved. The splash shield is inherently segmented into free sections between the braces.

While the splash shield may be a thin metal sheet supported to permit it to deflect without transferring forces to the braces, it may be formed of expanded metal with relatively small openings. The webs between the openings of the expanded metal should be arranged to taper toward the spray ring in the direction of airflow. The strains from any local quenching of this expanded metal may be readily absorbed in the distortion of the metal itself without placing high stress loading on the shroud.

DESCRIPTION OF THE PREFERRED EMBODIMENT

Figure 1:
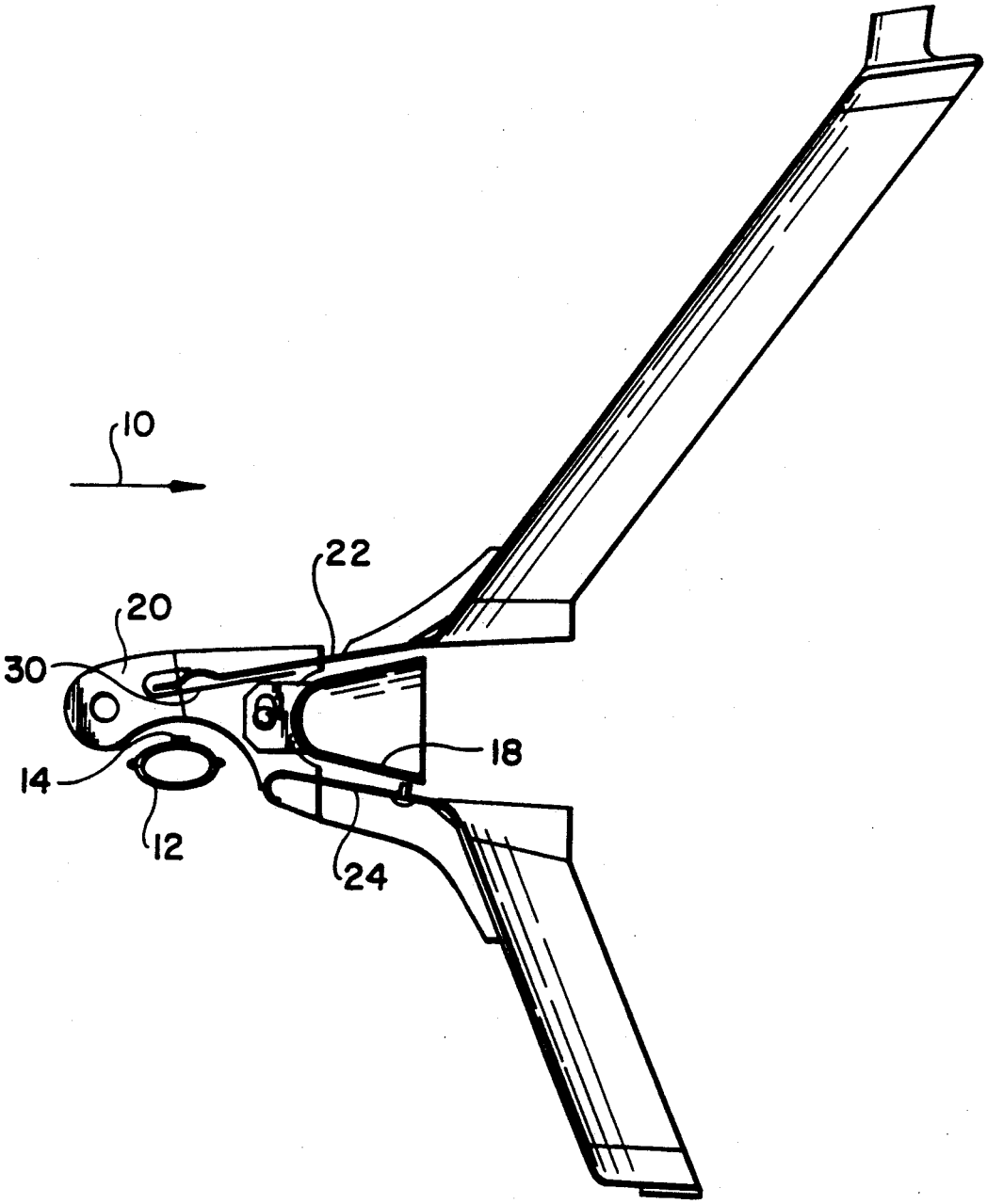
FIG. 1 is a section showing the flameholder gutters and support.

A gas turbine engine produces downstream of the turbine an axial airflow 10 in which is located an augmentor. This includes a fuel spray ring 12 which is circumferential and has a plurality of spray nozzles 14 emitting a spray of fuel 16.

A circumferential U-shaped gutter 18 is located immediately downstream of the spray ring. This is supported on a plurality of braces 20.

Also supported from the support braces 20 is a circumferential inner shroud 2 located radially inside of gutter 18. A circumferential outer shroud 24 is located radially outside of the gutter. These shrouds are arranged to confine fuel 16 from the spray ring as well as a portion of the airflow 10 to the zone of the gutter 18.

Figure 2:
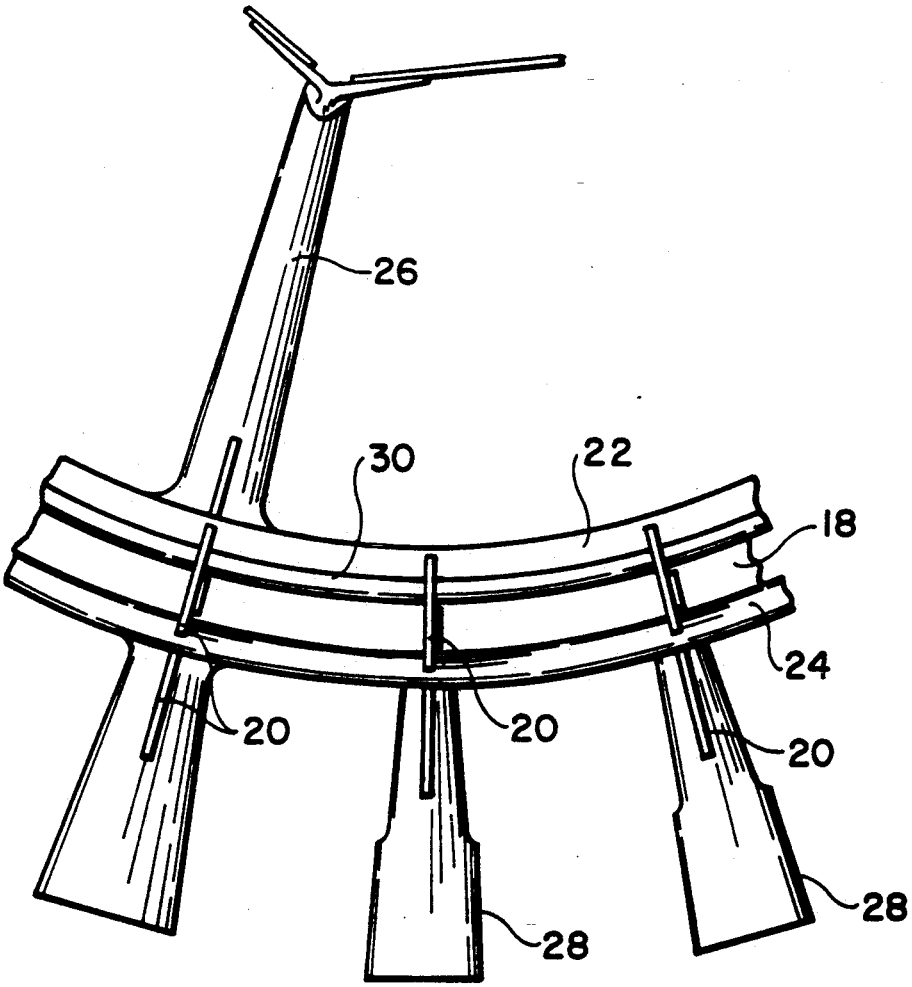
FIG. 2 is an end view showing the spacing of the supports.

Referring also to FIG. 2, the circumferential spacing of the support braces 20 can be seen. The inner shroud 22 also carries a plurality of radially inwardly extending gutters 26. Radially outwardly extending gutters 28 are supported from the outer shroud 24.

Figure 3:
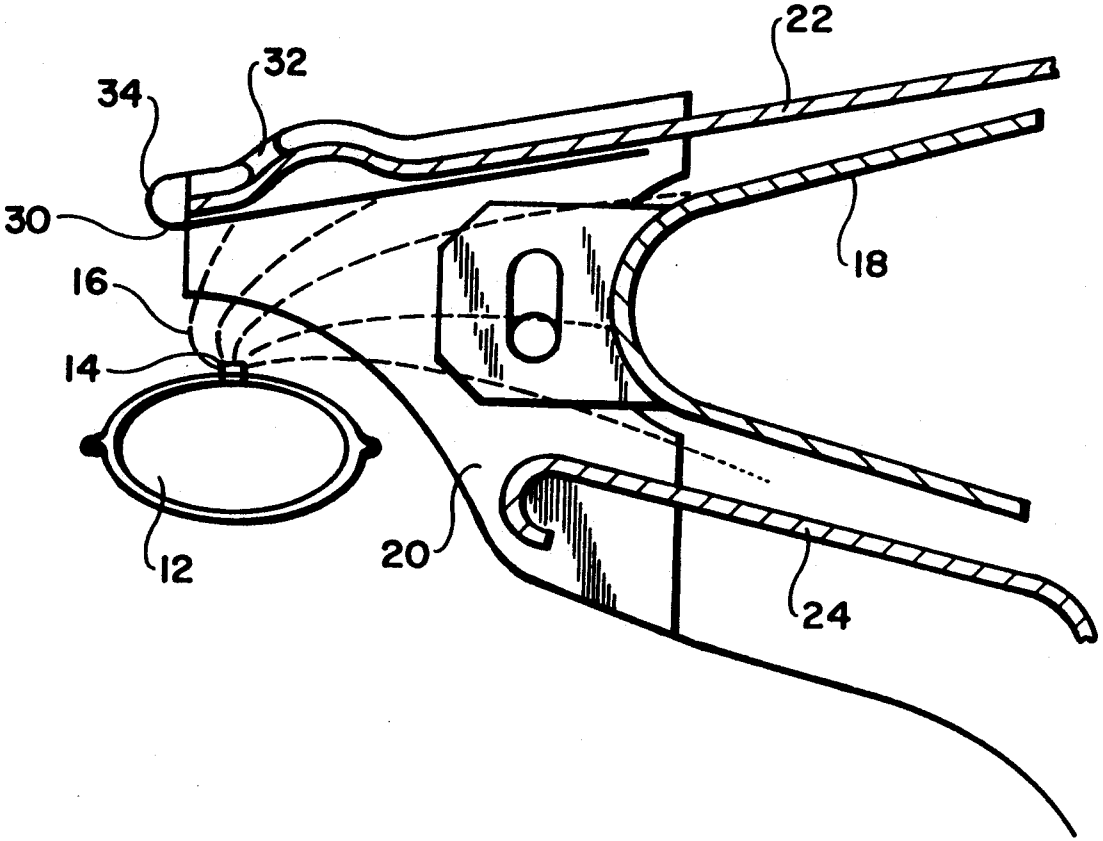
FIG. 3 is a section showing the splash shield.

Referring also to FIG. 3, a splash shield 30 is secured to the inner shroud 22 by welding at location 32. The splash shield is a thin metal sheet and is segmented as it is placed between braces 20. A bent portion 34 of the splash shield is bent away from the location of spray ring 12. The weld 32 is located on this bent portion.

In the absence of the splash shield, liquid fuel particles 16 may impinge upon the shroud 22 locally quenching and cooling it. The shroud is operating in a gas temperature of approximately 1500 F, and can be quenched locally to 500 F by the fuel while the support brace remains at 1500 F. This local cooling of the shroud causes contraction and high stress concentrations at the weld between the shroud 22 and the support brace 20.

The splash shield 30 protects the shroud 22 from this impingement. The splash shield itself does experience this quenching. Since it is segmented and free to move with respect to both the shroud and the supports, it does not directly transfer forces thereto. By welding at location 32 around the bend 34, the bend material offers an opportunity for the local strains to even out and only moderate forces can be placed on the shroud at the weld location.

Figure 4:
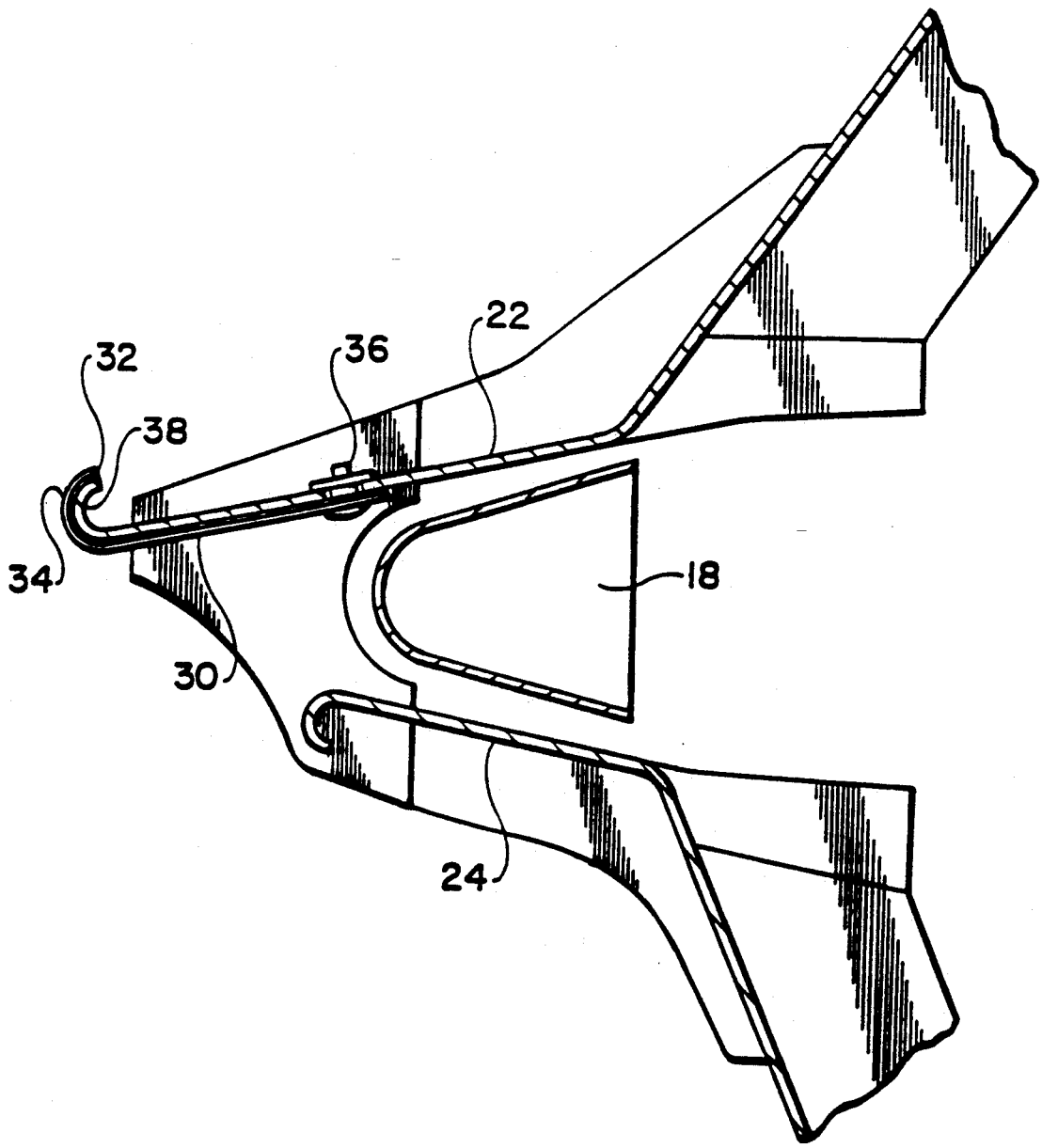
FIG. 4 is an expanded section showing the shield support in more detail, and also showing an alternate shroud design.

FIG. 4 shows support rivets 36 slidingly supporting the downstream end of the splash shield 30. It is noted that in this figure the inner shroud 22 is of an alternate construction with the return bend 38 providing stiffness of the shroud. Again, however, weld 32 is located around bend 34. With the direction of the spray 16 as indicated, the shield is required on only one of the two shrouds. Should the spray be introduced in such a way as to endanger outer shroud 24 with quenching, a shield may also be added at that location.

Figure 5:
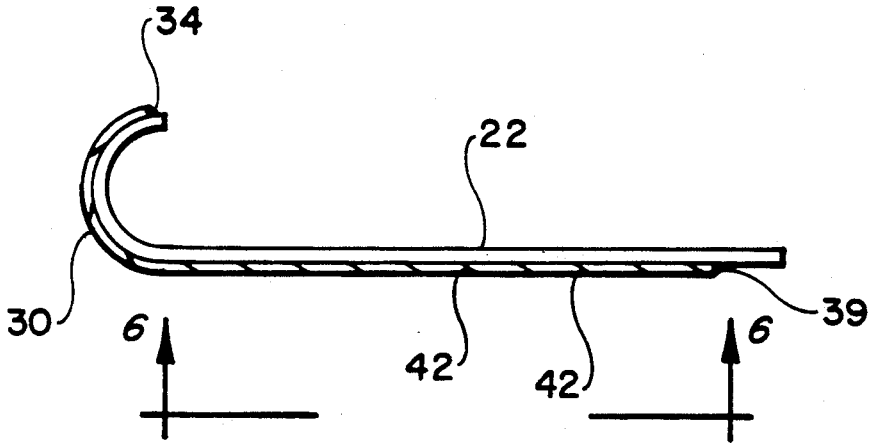
FIG. 5 is a section showing an expanded metal shield.
Figure 6:
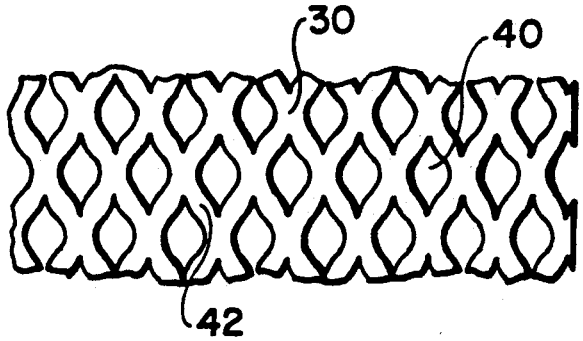
FIG. 6 is a section showing the expanded metal.

In the embodiment shown in FIG. 5, the splash shield 30 secured to shroud 22 is made of expanded metal as illustrated in FIG. 6. Since this expanded metal inherently has the ability to accept local strains it may be welded to the shroud both at location 34 at the upstream end and location 39 at the downstream end.

The openings 40 in the expanded metal are preferably made to be relatively small and the webs 42 between the openings are oriented such that the webs 42 taper inwardly toward the spray ring in a direction of airflow. This deters liquid fuel from impact against the shroud ring 22.

Low cycle fatigue cracking at the support-shroud interface is avoided, leading to a longer service life.

We claim:

1. A flameholder construction for a gas turbine engine having an axial airflow, an augmenter, and a fuel spray ring comprising:

a circumferential gutter located immediately downstream of said spray ring;

a circumferential inner shroud located radially inside of said gutter;

a circumferentially outer shroud located radially outside of said gutter, the area between said inner shroud and said outer shroud comprising the zone of said gutter;

said shrouds arranged to confine fuel from said spray ring and a portion of the airflow to the zone of said gutter;

a plurality of support braces welded to one shroud, of said inner shroud and said outer shroud, at circumferentially spaced locations, the circumferential space between adjacent support braces comprising an area between said support braces; and a splash shield secured to said one shroud and interposed between said one shroud and said fuel spray ring in the area between said support braces.

2. An apparatus as in claim 1, comprising also:

said splash shield secured to said one shroud at a location remote from said fuel spray ring with respect to said axial airflow.

3. An apparatus as in claim 1, comprising also:

said splash shield having at its upstream edge a bent section bent away from the location of said spray ring; and said bent portion of said splash shield secured by welding to said one shroud.

4. An apparatus as in claim 2, comprising also:

said splash shield also slidingly supported from said one shroud at a downstream portion of said shroud.

5. An apparatus as in claim 2, comprising also:

said splash shield comprised of expanded metal and also welded to said shroud at a downstream portion of said splash shield.

6. An apparatus as in claim 5, comprising also:

said expanded metal having webs between and defining openings therein and installed with the webs of said expanded metal, said expanded metal tapering radially toward said spray ring in the direction of airflow.

7. An apparatus as in claim 1, comprising also:

said support braces welded to both said inner shroud and said outer shroud.

8. An apparatus as in claim 3, comprising also:

said support braces welded to both said inner shroud and said outer shroud.

9. An apparatus as in claim 4, comprising also:

said support braces welded to both said inner shroud and said outer shroud.

10. An apparatus as in claim 6, comprising also:

said support braces welded to both said inner shroud and said outer shroud.

* * * * *